United States Patent [19]

Perkins

[11] 4,111,271

[45] Sep. 5, 1978

[54] HYDRAULIC JARRING DEVICE

[75] Inventor: Lee E. Perkins, Houma, La.

[73] Assignee: Kajan Specialty Company, Inc., Houma, La.

[21] Appl. No.: 802,047

[22] Filed: May 31, 1977

Related U.S. Application Data

[63] Continuation of Ser. No. 605,057, Aug. 15, 1975, abandoned.

[51] Int. Cl.[2] ..... E21B 1/10

[52] U.S. Cl. ..... 175/297; 137/614.14; 137/614.21

[58] Field of Search ..... 175/248, 297, 321; 137/614.14, 614.21

[56] References Cited

U.S. PATENT DOCUMENTS

| | | | |
|---|---|---|---|
| 3,285,353 | 11/1966 | Young | 175/297 |
| 3,349,858 | 10/1967 | Chenoweth | 175/297 |
| 3,392,795 | 7/1968 | Greer | 175/297 |
| 3,399,741 | 9/1968 | Monroe | 175/297 |
| 3,429,389 | 2/1969 | Barrington | 175/297 |
| 3,491,838 | 1/1970 | Wilder | 173/73 |
| 3,566,981 | 3/1971 | Love | 175/297 |
| 3,729,058 | 4/1973 | Roberts | 175/297 |
| 3,851,717 | 12/1974 | Berryman | 175/297 |

*Primary Examiner*—Ernest R. Purser
*Assistant Examiner*—William F. Pate, III
*Attorney, Agent, or Firm*—Fleit & Jacobson

[57] ABSTRACT

There is disclosed a hydraulic jarring device in which an impediment mechanism for controlling the movement of a mandrel with respect to a barrel is exposed to a fluid pressure which is significantly reduced from that pressure generated by the tensional load applied to the jarring device by the hoisting apparatus used to recover an object lodged within a well bore. The impediment mechanism, in one embodiment, is actuated by one or more hydraulically operated plungers slidably mounted within the housing of the jarring device. The plungers cooperate with a control sleeve whose movement is in turn controlled by a metering valve operating at a pressure significantly less than that above the plungers, and having an effect on movement of the sleeve inverse to the tension generated by the hoisting apparatus. The metering valve, in one embodiment, comprises a movable helical plug having a needle nose which associates with a valve seat to control fluid flow. Upon the control sleeve reaching a predetermined position in its stroke, pressures are relieved and a hammer associated with the mandrel impacts against an anvil associated with the barrel.

In another embodiment of the impediment mechanism, the hydraulically operated plungers are replaced by helical springs. Also disclosed is a metering valve wherein the helical plug is replaced by a generally linear hydraulic choke.

29 Claims, 11 Drawing Figures

Fig. 1
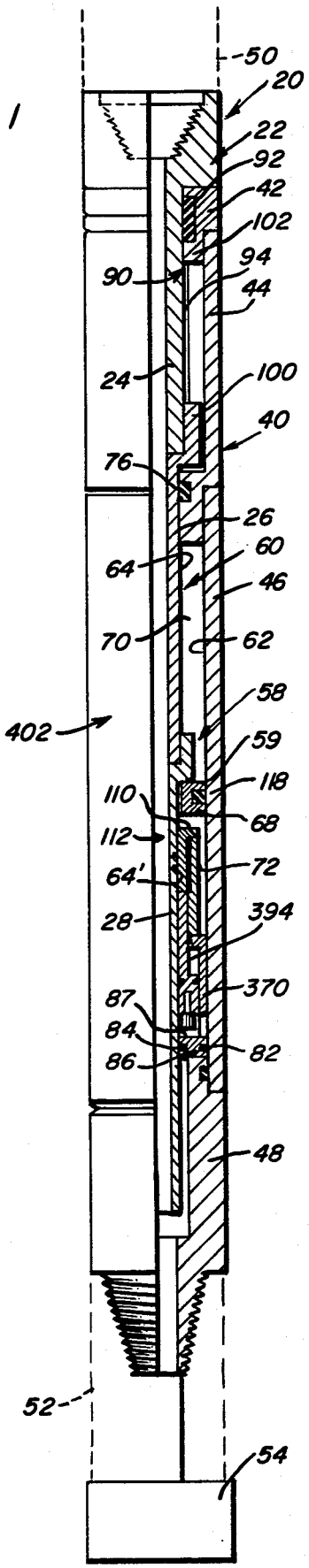
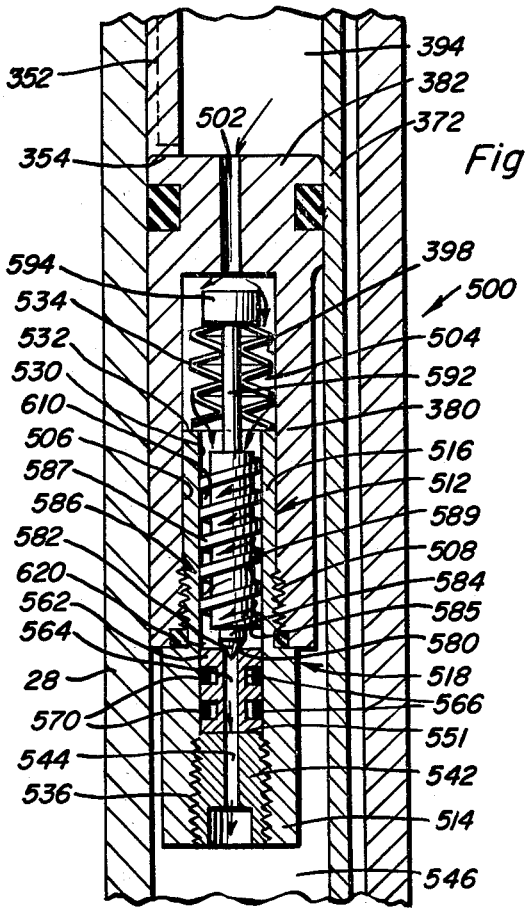
Fig. 7
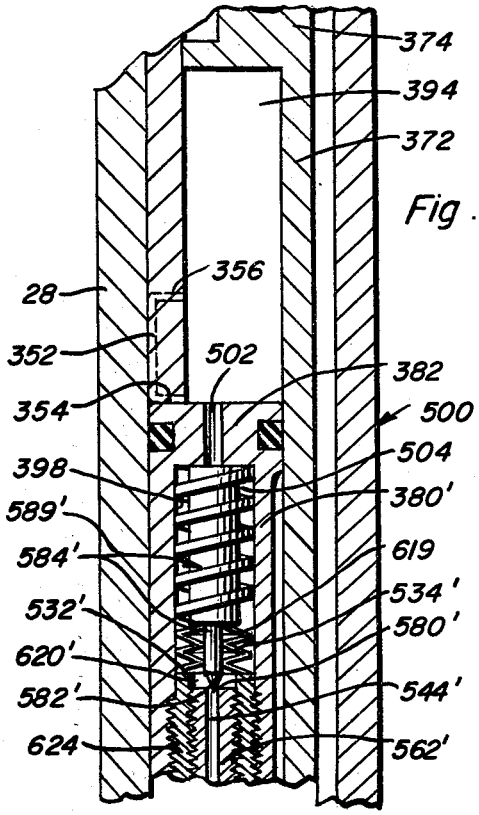
Fig. 8

HYDRAULIC JARRING DEVICE

This is a continuation of application Ser. No. 605,057, filed Aug. 15, 1975 now abandoned.

BACKGROUND OF THE INVENTION

The present invention relates to hydraulic jarring tools and more particularly to an apparatus for delivering an impact for freeing objects which may be lodged in an oil well or the like to free the same and permit recovery.

During drilling operations, such as are conducted in the oil industry, drill pipe or other objects occasionally become lodged in the drill hole. the lodging may result from a variety of causes, such as cave-ins, or the like but regardless of the cause, the lodging of the equipment presents problems. If the object is sufficiently lodged so that the equipment can be neither turned nor withdrawn by ordinary movement of the drill pipe, the well drilling operation will be impaired.

The equipment which has been developed for removing such lodged objects is commonly referred to as "fishing" equipment and has taken many forms over the years. A common form of "fishing" equipment is a hydraulic jarring device which is located at the lower region of a string of drill pipe. In known hydraulic jarring tools, the impediment mechanism which impedes movement of hydraulic fluid in the jarring tool is placed under the intense pressures generated by the surface-mounted hoisting apparatus. These known devices have not been totally satisfactory because the intensity or magnitude of the tension placed on the jarring tool often varies while the tool is being used. The metering arrangements used in known devices are such that, when the magnitude of the pull is changed, so too does the intensity of the pressures generated in the tool. Such varying pressures may result in undesirable variations in the magnitude of the jarring force applied to the fish.

Certain prior art devices utilized to free objects lodged in wells incorporate a mechanism for compressing a fluid within the tool, and then suddenly releasing that pressure to enable impact surfaces of the tool to engage and produce an impact which is transmitted to the lodged object. These prior art devices are generally complex and are designed in such a manner that the fluid, which is under intense pressure, is transferred or metered to control the movement of the mandrel. These known devices employ various mechanisms for regulating the flow of the fluid, and also frequently employ specific fluids to combat problems caused by the pressures and temperatures encountered in deep bore holes.

Most known deep well hydraulic jarring tools employ metal to metal seals between a jarring barrel and a distensible sleeve for controlling the telescoping movement of the jar. The shape of such barrels often becomes slightly eliptical, or otherwise distorted, and frequently produces unreliable operation. This distortion could result from using drill pipe tongs at well sites to tighten or loosen threaded sections. Furthermore, such distensible sleeves tend to leak under the intense pressures generated in a jarring operation and often become worn due to frictional engagement with other jar tool parts as they are pulled up the case prior to the tripping of the jarring device.

One known device is shown in U.S. Pat. No. 3,729,058 issued to Roberts on Apr. 24, 1973. This device utilizes axially spaced, sliding seals between the mandrel and the barrel to maintain a continuous fluid seal as the mandrel and barrel are moved axially relative to one another. During upward movement of the mandrel, pressure generated above an upwardly moving sleeve increases, causing a thin-wall section of the sleeve to distend radially outward and into sealing engagement with the wall of a compression chamber. Movement of the sleeve is impeded until a trip point is reached. See also, U.S. Pat. Nos. 3,566,981 and 3,429,389.

A further drawback of many known jarring tools is that impact is developed while resetting the tool. This could result in further lodging a fish, or increasing the time and number of strokes necessary to dislodge the tool.

Another drawback of known jarring devices is that the resetting operation requires a relatively long time. Obviously, since the resetting of the device accomplishes no useful work, the time needed to reset should be minimized.

The mechanism of the present invention overcomes the above-discussed drawbacks, as well as others, by providing a jarring device incorporating a simple, yet effective, movement impediment mechanism which is controlled by a metering system whose operation varies depending upon the load developed by the hoisting apparatus.

SUMMARY OF THE INVENTION

Briefly, the device of the present invention comprises a movement impediment mechanism used in a hydraulic jarring device which mechanism is subjected to pressures far less intense than those generated by the tensional load placed on the jarring device. The impediment mechanism of the present invention is located in an annular space between a jar barrel and a mandrel, and associates with a valved port for blocking or permitting fluid communication between a high pressure region and a low pressure region of the annular space. Cooperating impact surfaces mounted on the mandrel and the barrel impact and deliver jarring blows to lodged objects when the valved port is opened.

The impediment mechanism, in the preferred embodiment, is actuated by one or more cylindrical plungers slidably mounted relative to the mandrel. Downward movement of the plungers is developed at the commencement of a jarring stroke, and is controlled by a collapsing fluid chamber, with the discharge of fluid from such chamber, in turn being controlled by a metering valve. The metering valve, in the preferred embodiment, comprises a helical threaded plug movably mounted in a sleeve and having a needle nose at one end which associates with a valve seat to block fluid flow. Fluid pressure generated in the collapsing chamber controls the movement of the needle nose relative to the valve seat.

The impediment mechanism of the present invention is not subjected to the extremely harsh factors which are applied to the impediment mechanisms of known hydraulic jarring devices. By reducing the pressure applied to the impediment mechanism, the operation of the jar is more reliable and uniform than known hydraulic jars. Furthermore, very close control over the jar movement can be accomplished with the inventive device. And in addition the resetting of the jarring device is accomplished quickly, and without exerting a downward force by the device upon the lodged object.

It is, therefore, an object of the present invention to provide a jarring device with an impediment mechanism that is controlled by an inventive metering arrangement not subjected to the intense pressures generated by the tensional load placed on the jarring device.

A further object of the present invention is to eliminate metal-to-metal seals between the jar barrel and distensible sleeve in a jarring device.

Another object of the present invention is to provide a hydraulic jarring well tool which may be lowered into a deep well and coupled to a lodged object to dislodge the object by developing impact forces only in the direction necessary to release the lodged object.

A further object of the present invention is to provide a hydraulic jarring well tool which may be quickly and efficiently reset after actuation, to permit the delivery of repeated blows in a minimum amount of time.

Yet a further object of the present invention is to provide in a hydraulic jarring device, a mechanism for impeding movement between a hammer and an anvil and to then suddenly release the impediment so that an impact is imparted to extract a lodged object from a well, with the mechanism including a metering valve whose operation is sensitive to variations in the forces applied to the jarring device.

Another object of the present invention is to provide a hydraulic jarring tool with a metering valve which meters fluid inversely proportional to the force applied to the jarring tool by surface-mounted hoisting apparatus.

An additional object of the present invention is to provide a hydraulic jarring tool with a closed chamber having a movable pressure developing mechanism and a substantially reduced pressure responsive mechanism therein for effecting unidirectional impact action for releasing a lodged object, yet including rapid non-impact resetting capability to prevent further lodging of the object during resetting of the tool.

Still a further object of the present invention is to provide a hydraulic impact tool with a mechanism outside the pressure chamber for permitting rotation of the entire tool for connection to either another tool element or to a lodged object.

A still further object of the present invention is to provide a hydraulic jarring tool which includes a movable barrier to balance the hydraulics of the tool with the hydraulic head present in a well.

Yet a further object of the present invention is to provide a metering valve which is able to meter the flow of hydraulic fluid at a rate inverse to a hydraulic pressure applied at its inlet.

Another object of the present invention is to provide a simple, reliable and versatile metering valve whose operating parameters can be readily adapted to existing needs, and which can efficiently operate at both low and high pressures.

Still a further object of the present invention is to provide a hydraulic jarring tool that is of rugged construction, has prolonged service life, is simple to operate, and delivers maximum efficiency over an extended period of service life.

It is further the object of the present invention to provide a high pressure impact control mechanism that is responsive to the function of a hydraulic system which is operated at a substantially reduced pressure.

A further object of the present invention is to provide an impediment mechanism that includes a hydraulically operated metering mechanism which operates at a substantially reduced pressure.

Yet another object of the present invention is to provide a novel release mechanism for enabling the rapid dissipation of hydraulic fluid pressure for generating impacts between an anvil and a hammer in a jarring device.

These and other objects of the present invention, as well as many of the attendant advantages thereof, will become more readily apparent when reference is made to the following description taken in conjunction with the accompanying drawings.

BRIEF DESCRIPTION OF THE DRAWINGS

FIG. 1 shows an hydraulic jar built in accordance with the teachings of the present invention, which has been vertically sectioned to reveal the axial relationship of its basic components;

FIG. 7 shows an enlarged, vertically sectioned fragmentary view of a preferred embodiment of the metering valve for controlling the flow of fluid from the controlling chamber of the hydraulic jar;

FIG. 8 is an alternative embodiment of the metering valve shown in FIG. 7;

DETAILED DESCRIPTION OF THE DRAWINGS

Figure 2:
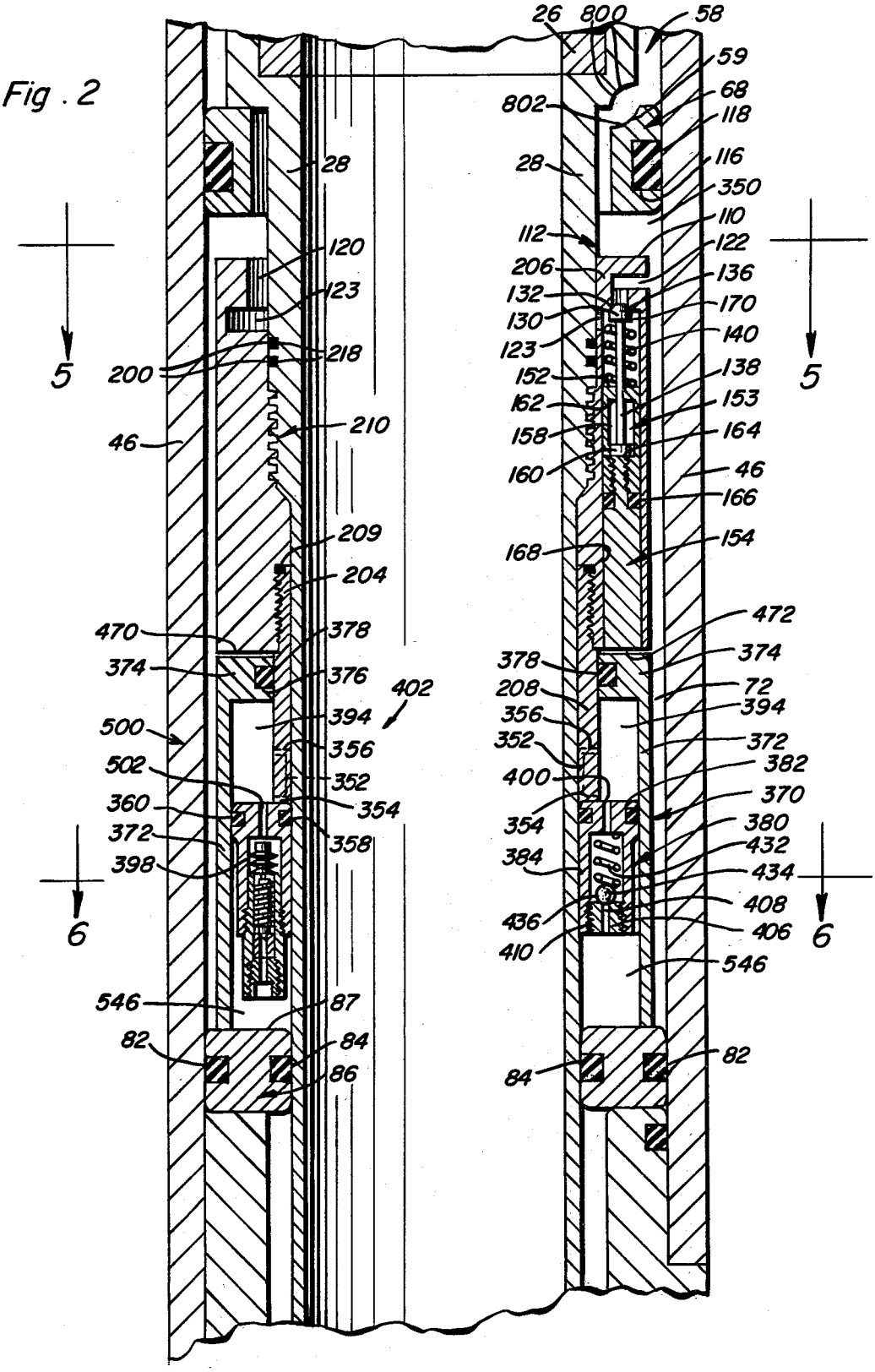
FIG. 2 is a cross section of the hydraulic jar shown in FIG. 1, illustrating the orientation of the movement impediment mechanism after the jar mandrel has been returned to a lower position in preparation for a jarring stroke.

FIG. 1 shows an hydraulic jar tool 20 in its closed position preparatory to the commencement of a jarring stroke. The jar 20 is illustrated in its upright, operational position.

The jar tool 20 comprises a generally tubular mandrel 22 which includes an upper mandrel section 24 thread coupled to a center mandrel section 26 which is in turn thread coupled to a lower mandrel section 28. The mandrel 22 is telescopingly mounted within a barrel 40 which comprises a key retainer 42 thread coupled to an upper housing 44. The upper housing is similarly connected to a case 46, which is itself likewise attached to a lower adapter 48. The junction between central mandrel section 26 and lower mandrel section 28 forms a shoulder shown generally at 58. The lower radially directed surface of the shoulder 58 forms an annular abutment face 59, the function of which will be described below.

In the usual manner, the mandrel 22 is supported on a conduit string 50 which extends upwardly to the well surface. At the well surface, the conduit string 50 is connected to a hoisting mechanism where the lifting force to be transmitted through the string to the mandrel is generated. The barrel 40, on the other hand, is connected at its lower end to a conduit portion 52 which extends downwardly to the element 54 temporarily lodged within the well bore.

A generally annular, fluid filled reservoir 60 is formed between radially inwardly facing cylindrical inner wall 62 of the case 46 and the radially outwardly facing generally cylindrical outer wall 64 of center mandrel section 26. Reservoir 60 extends into lower mandrel section 28 when the hydraulic jar 20 is in another stage of operation. In this stage, reservoir 60 is extended to outer surface 64 of lower mandrel section 28 and a lower region of inner surface 62 of case 46. A cylindrical sleeve 68 grooved as at 116 and housing a sealing element 118 forms a fluid-tight seal against surface 62 and divides reservoir 60 into an upper reservoir 70 and a lower reservior 72. Upper reservoir portion 70 is sealed and closed at the upper end thereof by a seal element 76 carried in the wall of the upper housing 44. The lower reservoir portion 72 is defined and closed at the lower end thereof by seals 82 and 84 carried on a piston element 86 positioned in the lower region of the case 46 and having an upwardly presented surface 87.

Rotation between mandrel 22 and barrel 40 is prevented by a key splined joint shown generally at 90. A plurality of keys 92 are provided in key retainer 42, and are disposed in elongated grooves 94 formed in the surface of upper mandrel section 24. Thus a splined configuration enables a slidable coupling between mandrel 22 and barrel 40, permitting telescopic motion but inhibiting rotation.

An annular, upwardly facing ledge-like hammer 100 is carried by mandrel 22. A cooperating downwardly facing, generally ledge-like anvil 102 is carried by the key retainer 42 above and in axial alignment with hammer 100. The hammer 100 and the anvil 102 form cooperating impact faces, with abrupt upward movement of the mandrel 22 with respect to barrel 40 bringing the hammer 100 into jarring engagement with the anvil 102 and delivering a jarring stroke to the conduit portion 52. Successive jarring strokes pull the lodged element 54 upwardly within the well bore.

The generally cylindrical sleeve 68 is telescopingly and slidably mounted inside barrel 40 between shoulder 58 and an abutment face 110 of a body 112. The sleeve 68 with its sealing element 118 functions as a movement-impediment, or pressure generating mechanism with the reservoir 60 to impede the movement of the mandrel 22. Axial movement of the sleeve 68 is limited by engagement of the upper and lower ends, respectively, with abutment faces 59 and 110.

As can best be seen in FIG. 2, fluid passage from upper reservoir chamber 70 to lower reservoir chamber 72 would be impeded when sleeve 68 is in contact with abutment face 110 of body 112. Yet there is fluid communication between chambers 70 and 72. A channel 120 is in direct communication with upper chamber 70 with sleeve 68 in contact with face 100. A port 123 is, in turn, in direct fluid communication with channel 120. The fluid circuit is completed by port 122 in the region of lower reservoir chamber 72. Channel 120 is out of alignment with port 122.

A conical plug 130 is sealingly seated in port 122. The plug 130 engages a seating surface 132 on the body 112 at its tapered upper end 136. The plug 130 is mounted on a valve rod 138 around which is positioned a spring 140 held in compression. The spring 140 is seated on an upwardly facing surface 152 of an extension 153 of a plunger shown generally at 154. The extension 153 is threadably attached to the upper region of plunger 154, and forms a yoke having an annular space 158 in which a radially enlarged section 160 of valve rod 138 is received. The enlarged section 160 limits the axial travel of the rod 138 between an inward radial shoulder 162 in the upper end of extension 153 and a surface 164 at the bottom of the space 158. A seal 166 is interposed between plunger 154 and extension 153, and engages a wall 168 in the lower region of an annular chamber 170 defined in the body 112.

The body 112 comprises an upper section 206 attached to the lower section of mandrel 22 as shown in FIG. 2 at joint 210, and a lower section 208 threaded to the upper section 206 at 204. An O-ring seal 209 is located in the region of screw threads 204, intermediate upper section 206 and lower section 208 of body 112. Two seal seats 218 are grooved into outer surface of lower mandrel section 28, and are provided with seals 220 which seat between the outer wall 64 of lower mandrel section 28 and the inner surface of upper body section 206.

The lower section 208 of body 112 contains fluid passages 352, 354 and 356, the function of which will be explained below. Adjacent these passages, the lower section of body 112 takes the form of a radial shoulder 382, grooved to receive respective seals 358 and 360.

Figure 3:
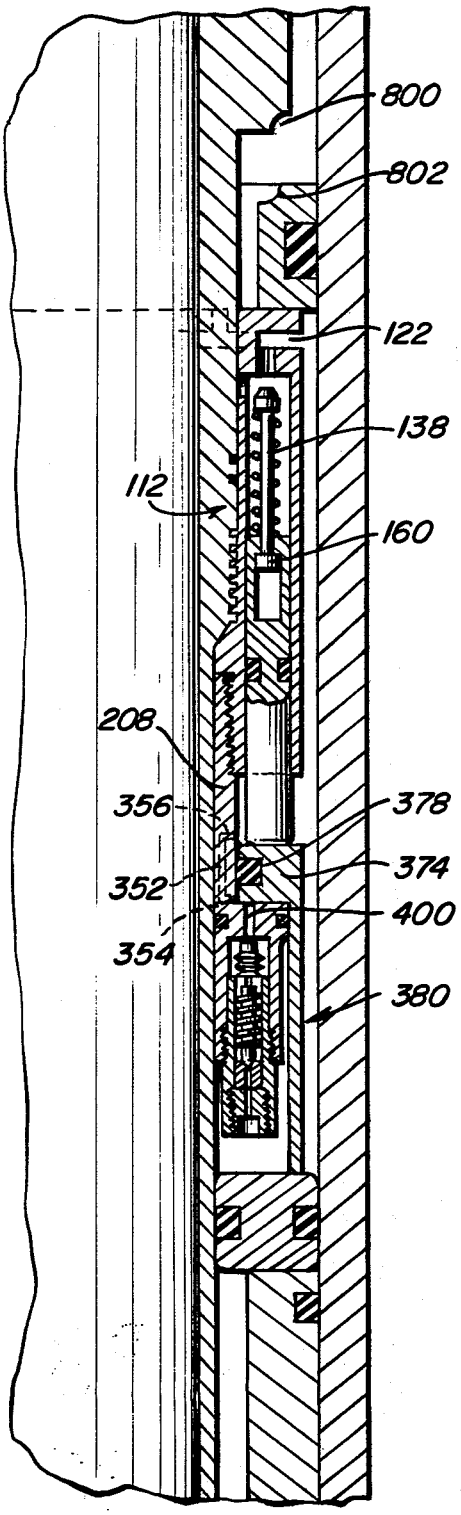
FIGS. 3 and 4 show the impediment mechanism of FIG. 2 in two further positions during operation, with FIG. 3 illustrating the mechanism in its released position.

A control sleeve shown generally at 370 is formed by a downwardly extending tubular sleeve 372 originating at a head 374. A seat 376 is provided in the head 374, and houses a seal 378 which seats against the inner surface of body section 208. As shown in FIG. 3, the axial length of head 374 is slightly less than the spacing between passages 356 and 354. Therefore, passages 352, 354 and 356 can serve as a fluid by-pass path around head 374, as will be later discussed in greater detail.

Figure 4:
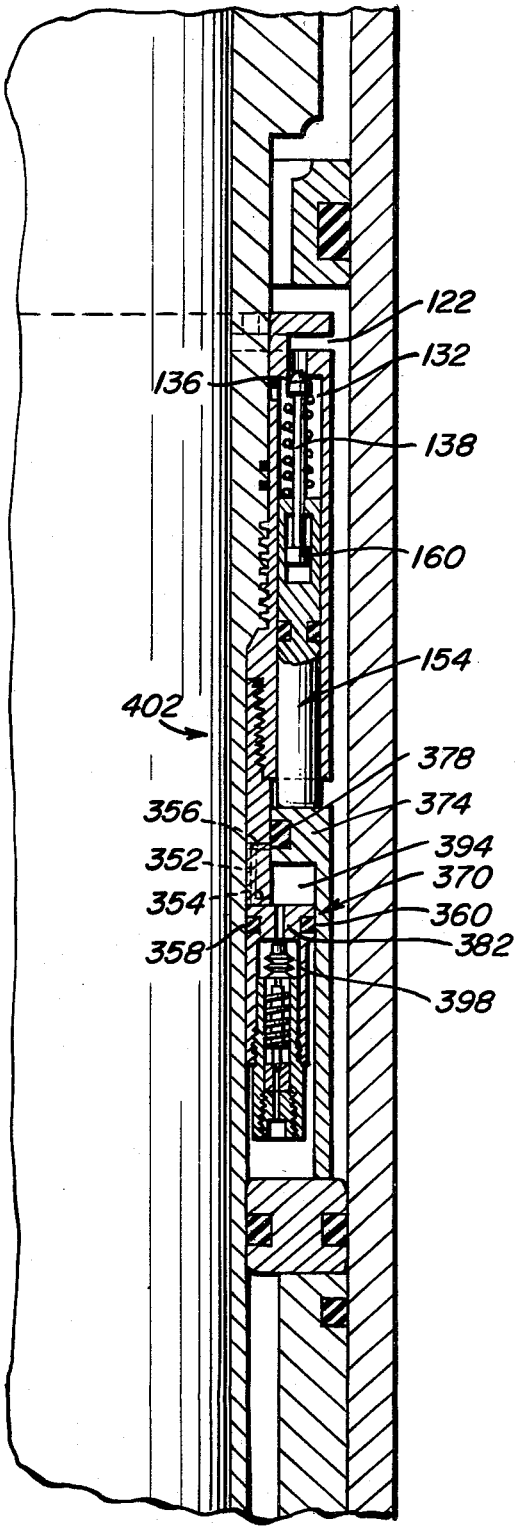
Figure 5:
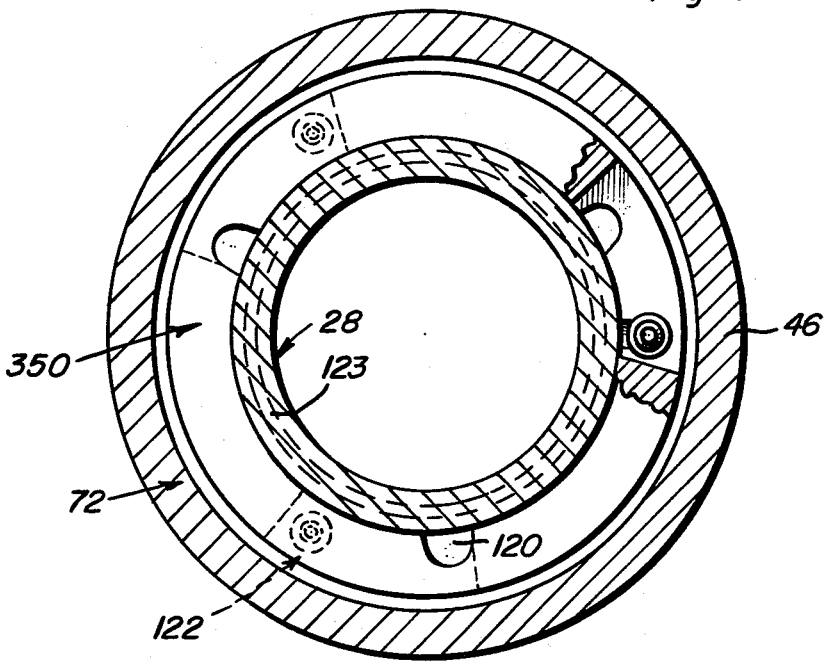
FIGS. 5 and 6 are respective cross-sectional views taken along planes 5 and 6 of FIG. 2.
Figure 6:
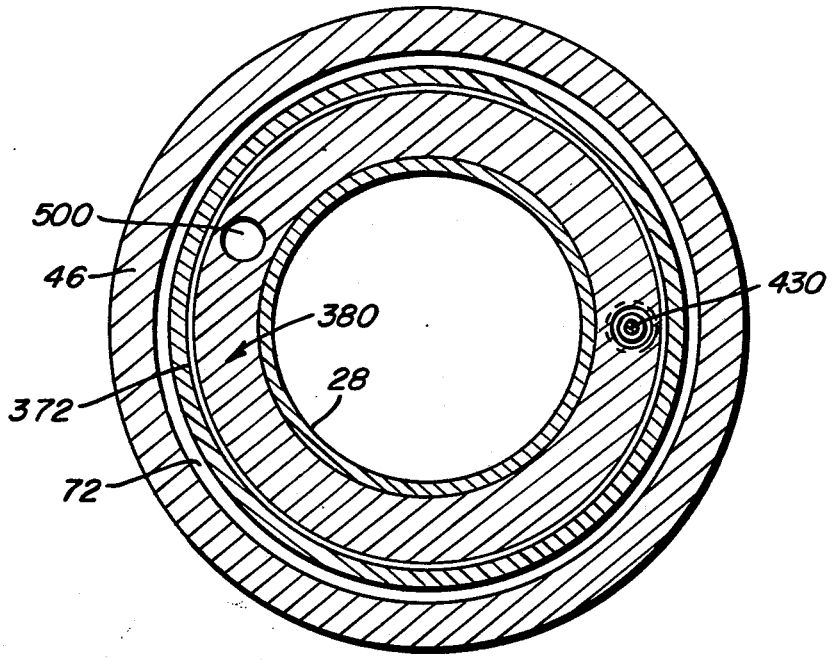

With reference now to FIGS. 2 through 4, further details of the impediment mechanism 402 will be described. The lower extremity of body section 208 is provided with a sleeve or tail section shown generally at 380. The top of section 380 is defined by a ledge 382 at the base of body section 208, and the bottom of section 380 is defined by a downwardly extending skirt 384. A valve chamber 394 is defined by sleeve 370, body section 208 and ledge 382, and is adapted to contain a suitable operating fluid, such as light oil or the like. As shown, the ledge 382 is disposed over the lower body section 208, and is sealed thereto by the seals 358 and 360 to seal chamber 394. By comparing FIGS. 2 and 4, it can be seen that chamber 394 collapses during the movement of the mandrel 22. To enable this collapse, ledge 382 is equipped with a passageway 502 which provides fluid communication between chamber 394 and an axial bore 398 of tail section 380 in the region of a metering valve 500 (FIG. 2).

Threadably connected at 410 to the lower extremity of tail section 380, is an annular plug 406 having an orifice 408 therethrough. Valve chamber 394 is equipped with a check valve 430 comprising a ball 434 and a spring 432 biasing the ball into seating engagement in a ball seat 436 integral with orifice 408. The check valve permits upward flow of fluid between lower reservoir chamber 72 and valve chamber 394, but prevents downward flow of fluid through port 400 by blocking orifice 408.

With the impediment mechanism 402 in the position shown in FIG. 2, an upwardly presented surface 470 of head 374 abuttingly engages a downwardly presented surface 472 of plunger 154. As shown in FIG. 3, on the other hand, the impediment mechanism 402 is in its other extreme position. Here, an impacting blow is being delivered, and the head 374 takes a position between passages 354 and 356. An intermediate position of the impediment mechanism 402 is illustrated in FIG. 4.

The preferred form of a meter valve 500 forming a part of the impediment mechanism 402 is shown in FIGS. 2 and 7. In this embodiment, the mechanism is in cartridge form, and hence can be attached to a pressure device and preset prior to installation in the jar device. The meter valve 500 is located in the jar tool 200 in a position 180° away from the just-discussed check-valve 430. As shown in FIG. 7, meter valve 500 meters fluid flowing through an outlet passageway 502 located in a ledge 382 separating the valve chamber 394 from a metering chamber 504 formed within the axial bore 398 of the tail section 380. An insert 512 is threaded into tail section 380, at 508, and comprises a downward extension 514 and an upwardly extending internal sleeve section 516 extending into thread region 508. The sleeve section 516 snugly fits within a bore 506 in the tail section 380. The outer diameter of downward extension 514 is larger than the outer diameter of sleeve section 516, and thereby forms an abutment shoulder 518 at the lowermost region of tail section 380. The lower region of downward extension is sized so as to remain out of contact with the lower mandrel section 28 and the sleeve 372.

An axial bore 530 extends through the entirety of the insert 512, but terminates in the lower region of downward extension 514 in threads 536. The upward termination of the sleeve section 516 presents an upwardly directed shoulder 532 upon which abuts the lower end of a compression spring 534, shown as Belleville washers. An adjustment element 542 is threaded into the bottom of extension 514, at threads 536, and has a passageway 544 extending therethrough. Passageway 544 terminates in an exit chamber 546 at the lower extremity of the meter valve 500, where chamber 546 is integral with lower reservoir 72. The adjustment element 542 extends upwardly in the threaded section 536, and presents an upwardly directed abutting surface 551 at its upper terminus.

In abutting engagements with surface 551 of element 542 is an abutting surface 560 of a valve seating element 562 which extends from surface 551 toward the abutment shoulder 518. Seating element 562 is equipped with a passageway 564 extending completely therethrough. Two seating grooves 566 are positioned in the surface of element 562 and are equipped with a pair of seals 570 which engage the inner surface of bore 530. Passageway 564 has a diameter substantially equal to that of passageway 544 in the adjustment element 542.

The uppermost region of passageway 564 in seating element 562 takes the form of a valve seat 580. A conical engaging nose 582 at the lowermost end of a valve stem 584 is adapted to reside in valve seat 580, and is part of a meter system bleeder valve shown generally at 586. When the nose 582 is seated in valve seat 580, the nose blocks fluid flow through the inlet of passageway 564. With the nose 582 slightly withdrawn from seat 580, a small amount of fluid can flow past the valve and through passageways 564 and 544.

Valve stem 584 extends upwardly from the base of valve engaging nose 582, and is mounted on a downwardly presented face 585, defining the lowermost extremity of a helical plug or bleeder valve body 589. Valve body 589 is generally cylindrical with the outer diameter of its threads 587 being slightly less than the diameter of bore 530, thereby defining a spiral duct 610 between the spiral base of threads 587 and the wall of bore 530.

A valve stem 592 extends upwardly from the top of bleeder valve body 589, and has threadably mounted on its uppermost end, a threaded spring adjustment nut 594. The Belleville washers 534 are retained by the valve stem 592, and are held in compression by engagement of the adjustment nut 594.

Turning now to FIG. 8, an alternative embodiment of the metering mechanism 500 will be described. In this embodiment, Belleville compression springs 534' are positioned between a face 619 defining the lower region of the helical valve body 589 and a should 532' of a spring retainer 624. Retainer 624 is externally threaded into the lower region of the tail section 380', substantially identical to the tail section 380 described above when reference was made to FIG. 7. The spring retainer 624 is also internally threaded, and supports a valve seating element 562' having a passageway 544' therethrough. The operation of the alternative embodiment illustrated in FIG. 8 is similar to that of the preferred embodiment shown in FIG. 7. In FIG. 7, the compression in spring 534 is adjusted by means of adjustable sleeve section 516. The relationship between nose 582 and valve seat 580 is adjusted by means of element 542. In FIG. 8, spring compression is changed by adjusting retainer 624, while valve seating depends upon the position of element 562'.

The operation of the inventive hydraulic jarring device will now be presented, and for the sake of clarity, will be divided into two sections. The first section will deal with the metering valve 500 and the second relates to the hydraulic jar in its entirety.

The operation of the meter valve 500 is best understood when reference is made to FIGS. 2 and 7. As will be described in greater detail below, pressure is generated in valve chamber 394 by the operation of the hoisting apparatus acting on the jarring device. This pressure urges the fluid housed in chamber 394 to enter passageway 502 of the tail section 380. This fluid then travels around the helical threads in spiral duct 610 of the valve body 589 and into a chamber 620 between valve body 589 and valve seat 562. The passage of fluid through the spiral duct 610 results in a pressure drop which generates a force on the valve body 589 in a downward direction. This force causes the Belleville springs 534 to collapse, and hence the tapered nose 582 of the body 589 is urged toward the valve seat 580 in element 562.

With nose 582 associating with valve seat 580, the pressure in the chamber 620 increases and approaches that pressure which is developed in chamber 394. At this time, the springs 534 will move the tapered nose 582 away from the seat 580 until pressure equilibrium is reached. The fluid will then exhaust from chamber 620 through passages 564 and 544 and enter chamber 546. It should be noted that the spring force should be of such a magnitude as to overcome the force of the pressure in chamber 394 acting across the area of the sealing surface of the needle nose. In this manner, the fluid flow rate through valve 500 is automatically controlled by the pressure drop across body 589 and the springs 534 and the total pressure in chamber 394 acting on the area of the difference between the outside diameter of sealing surface of nose 582.

In the embodiment illustrated in FIG. 8, the operation is the same. Fluid pressure in chamber 394 moves body 589' against the bias of springs 534' so that nose 582' moves toward seat 580'. Then, pressure in chamber 620' increases, and the Belleville washers 534 force the body 589' upwardly, and moves nose 582' away from seat 580' until equilibrium is reached. As the pressure in chamber 394' increases, the force created by this pressure in nose 582' also increases. Therefore, the pressure drop across body 589' decreases, and the meter 500 reduces the fluid flow rate as pressure in chamber 399 increases.

It is also to be noted that the differential between the pressure in chamber 394 and that in chamber 620 acts on the area of the difference between the outer diameter of the retainer 624 and that of the sealing surface of the nose 582. The area of the sealing surface of the nose 582 is, in turn, affected by the total pressure in chamber 394.

With the inventive meter valve 500, as noted above, high pressure in chamber 394 results in a low differential pressure (or pressure drop) across the helical threads of valve body 589. A lower pressure in chamber 394, in turn, increases the differential pressure across valve body 589. This differential pressure, or pressure drop affects the meter operation in the following manner. With a high pressure drop, there is a high fluid flow rate through the spiral duct 610. This high flow rate permits the jarring tool to trip in a relatively short time period. A low pressure drop, on the other hand, trips the tool in a longer period of time. This timing is important to the time required by the hoisting equipment used to place the desired tension on the drill string. With the inventive system, the greater the desired tension, the longer is the time period necessary to achieve this desired tension.

Having described the operation of the meter valve 500, the operation of the hydraulic jar 20 will now be presented. As aforementioned, the jar illustrated in FIG. 1 is shown with the impediment mechanism 402 in the closed or preparatory position ready for the commencement of a jarring stroke. In this position, the cylindrical sleeve 68 is in contact with abutment face 59 of shoulder 58. The bottom end of control sleeve 370 is in contact with upwardly presented surface 87 of piston 86, and chamber 394 has been filled with jar fluid through check valve 430 in tail section 380 (FIG. 2). It should be noted that this filling is effected by the hydraulic head in the well bore, and the ability of piston 86 to balance hydraulic forces. If piston 86 were not used, then a spring could be used to drive control sleeve 370 in an upward direction. Also to be noted is that during the setting operation, fluid passage is permitted between the contacting faces of sleeve 68 and shoulder 58. In particular, the shoulder 58 is provided with channels 800, while channels 802 are cut into sleeve 68. As a result, contact between shoulder 58 and sleeve 68 cannot interrupt fluid flow through the respective cooperating channels 800 and 802.

Before continuing with the discussion of the operation of the jarring device, it should be mentioned that for ease of description, the operation will be described on the basis of a single plunger 154 and associated mechanism. In actuality, any number of plungers 154 can be used, with the addition of each plunger resulting in a further differential between the high pressure and low pressure sides of the device.

As the mandrel 22 is raised with respect to the barrel 40, best seen in FIG. 2, the tapered surface 136 of the plug 130 sealingly contacts the valve seat 132 of body 112, closing port 122. Continued upward movement of the mandrel causes a pressure to be generated on the fluid in the reservoir 60. This generated pressure in chamber 60 is transmitted through the channel 120 of body 112 and into chamber 170. With this added fluid pressure the conical head 136 of plug 130 is further urged against its valve seat 132 sealing the port 122. This same generated pressure also acts on the seal 166 in the plunger 154 and is transmitted by plunger 154 to the control sleeve 370 through the abutting contact between the bottom of plunger 154 and the head 374 of sleeve 370. Continued movement of the mandrel 22 causes the plunger 154 to be forced downwardly along wall 168, and hence sleeve 370 is also moved. This intermediate position of elements is shown in FIG. 4, illustrating the lowering of plunger 154 and control sleeve 370, while the conical head 136 of plug 130 remains seated in valve seat 132.

Being filled with fluid, the valve chamber 394 resists the downward movement of the plunger 154 and sleeve 370. However, the fluid in chamber 394 is slowly exhausted through meter valve 500 and into chamber 546, around the lower extremity of sleeve 372, and into reservoir 72 below sleeve 68.

With continued movement of plunger 154 and sleeve 370 from the position shown in FIG. 4 into that position shown in FIG. 3, the seal 378 of head 374 crosses over the fluid passage 356 in the lower section 208 of body 112. The fluid remaining in the chamber 394 vents through fluid passages 354, 352, and then 356, entering reservoir 72. This permits the full force acting on the plunger 154 to complete the travel required. The radially enlarged section 160 of the valve rod 138 contacts the shoulder 162 at the same time that seal 378 crosses over fluid passage 356. This permits the full force of the plunger 154 to suddenly pull the conical plug 130 away from valve seat 132, thereby opening port 122. With port 122 open, there is rapid dissipation of the generated pressure in chamber 70 to chamber 72. The sudden releasing of the generated pressure permits the rapid upward movement of the mandrel 22 until the hammer 100 strikes the anvil 102, thereby delivering the desired jarring blow.

As mentioned above, in the preferred embodiment, there are three plungers 154. With the three plungers, and the inventive design, the meter 500 is not subjected directly to the high pressures generated by the tensional pull applied to the hydraulic jar. Thus, for example, a 10,000 psi pressure generated in chamber 70 is reduced to a pressure of 920 psi in chamber 394. Each of the three cylindrical plungers 154 has an outside diameter of 0.3125 inches (totalling 0.230 sq. in.) and the chamber 394 has an area of 2.5 square inches. Thus the pressure of 10,000 psi multiplied by the area of the plunger surfaces, (0.230 sq. in.) results in a force of 2,300 pounds. By dividing this force by the area at chamber 394 (2.55 sq. in.) it can be seen that meter 500 operates at 920 psi, rather than the full 10,000 psi. The advantages of this reduced pressure are discussed above.

With the 920 psi acting on the metering valve 500, the pressure drop across the spiral valve body 589 will be explored. The area of the sealing nose 620 is taken to be 0.0038 square inches, and that of body 589 to be 0.0764 square inches. With $P_1$ being the above - noted 920 psi in chamber 394, $P_2$ being the pressure in chamber 620 beneath body 589, and $P_3$ being the pressure drop across the helical threads 587 ($P_1 - P_2$), then $$(P_1 - P_2)(0.0764 - 0.0038) + 0.0038P_1 = 11.7,$$

where 11.7 represents the force exerted by springs 534. Solving for $P_2$, the pressure in chamber 620 is 806.99 psi. Then, it can be determined that $P_3 = 113$ psi. By reducing the pressure in chamber 394 ($P_1$) to 450 psi, the pressure drop across threads 587 ($P_3$) becomes 147.39 psi. That is, a reduction in the pressure in chamber 394 results in an increased pressure drop across the threads 587. And this increase in pressure drop across the threads 587, in turn, results in an increased flow of fluid through the meter 500. Accordingly, when the hoisting device exerts a large pull on the mandrel of the inventive tool, the tripping time of the tool is lengthened. On the other hand, when the hoisting apparatus exerts a lesser pull to develop less of an impact, then the tripping time is correspondingly shortened.

Figure 9:
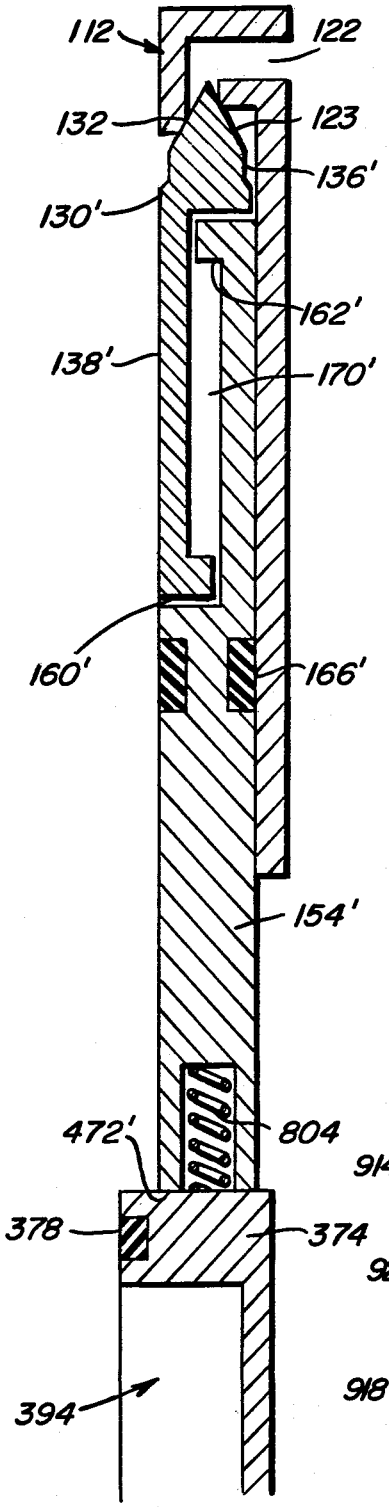
FIG. 9 is a cross section of a preferred construction of the impact control mechanism utilized to rapidly release and dissipate high pressure hydraulic fluid.

With reference now to FIG. 9, a preferred construction of the impact control mechanism will be described. The mechanism at FIG. 9 is quite like that illustrated in FIG. 2, and hence corresponding elements have been denoted with "primes." As will be recalled when reference was made to FIG. 2, forces exerted on the mandrel by the hoisting apparatus develop high pressures in port 123. The port 123 of FIG. 9 houses the same high pressure hydraulic fluid. This high pressure fluid communicates with a chamber 170' and forces a plug 130' into sealing engagement with the seating surface 132 of body 112. Accordingly, communication between ports 122 on the low pressure side of the hydraulic system and port 123 on the high pressure side of the system is interrupted. At the beginning of the jarring stroke, the head 374 of control sleeve 370 abuts against the lower surface 472' of a plunger element 154'. However, the high pressure hydraulic fluid in port 123 acts in chamber 170', and the plunger 154' is urged in a downward direction, against the head 374 of control sleeve 370. However, the hydraulic fluid in chamber 394 beneath head 374 resists the downward movement of the control sleeve 370. And, as will be recalled this fluid in chamber 394 is slowly metered by the inventive metering system 500 (not shown in FIG. 9).

As the meter valve 500 meters the hydraulic fluid from chamber 394, plunger 154' is permitted downward movement. This movement slowly continues until the shoulder 162' which is at the upper region of the main body of plunger 154' comes into contact with a cooperating shoulder on the upper surface of an enlarged section 160' of the plug 130'. As was the case in the impact control mechanism described when reference was made to FIG. 2, shoulder 162' of the plunger 154' contacts the abutting surface of the enlarged section 160' at the same time that the seal 378 of the control sleeve 370 crosses fluid passage 356 (not shown in FIG. 9). Further downward movement of plunger 154' acts on the enlarged section 160', and through valve rod 138' moves the tapered faces 136' of the plug 130' out of engagement with the sealing surfaces 132 of the body 112. At this occurrence, there is immediate communication between the respective ports 122 and 123, with the result of a rapid dissipation of the high pressure hydraulic fluid, releasing the impediment between the mandrel and the barrel and hence enabling the hammer to impact against the anvil. A coil spring 804 provided in a recess in the lower portion of plunger 154' abuts against the head 374 of the control sleeve 370 and serves to ensure that in the initial stages of a jarring stroke, the tapered faces 136' of the plug 130' are in sealing engagement with the cooperating sealing surfaces 132 of body 112. In all other respects, the impact control mechanism described in FIG. 9 is the same as that described in FIG. 2.

Figure 10:
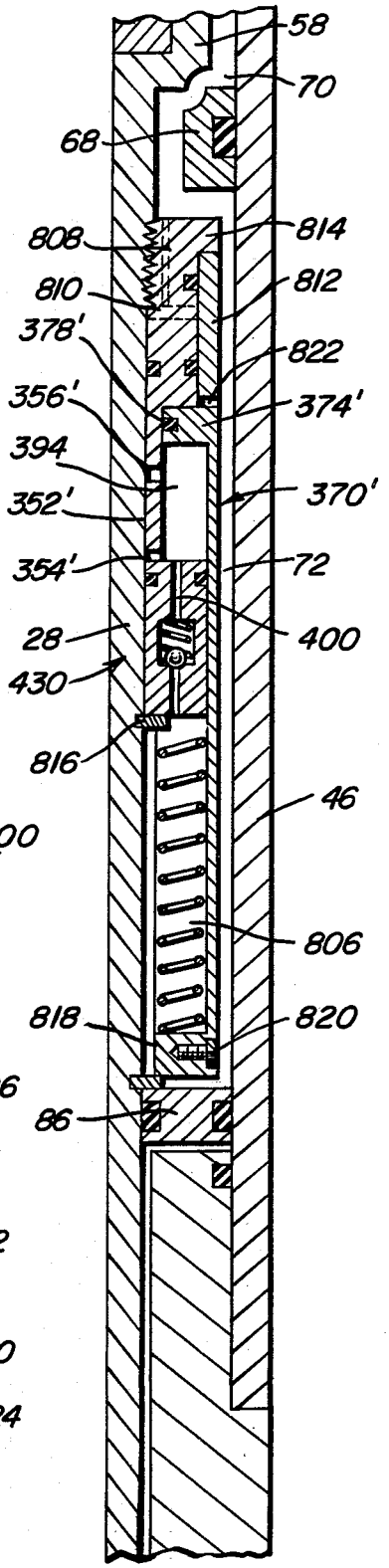
FIG. 10 is a cross section of a further embodiment of the inventive impediment mechanism wherein a helical spring replaces the force generating plunger illustrated in FIG. 2.

Turning now to FIG. 10, there is shown another embodiment of the inventive impediment mechanism. In this embodiment, the hydraulically operated plungers 154 are replaced by helical coil springs 806. Again, because the operation of the impediment mechanism illustrated in FIG. 10 is substantially the same as that described above, only the differences will be detailed.

In FIG. 10, it can be seen that communication between the high pressure reservoir 70 and the low pressure reservoir 72 is made possible through fluid passage slots 808 and ports 810. These slots 808 and ports 810 are formed in the upper portion of a body 814, the lower portion of which forms a cylindrical sleeve having ports 354' and 356' connected by slots 352'.

An elongated valve 812 is disposed within the case 46 and slides over body 814. As can be seen, the valve 812 has a cylindrical sleeve which covers the ports 810 when in the position illustrated in FIG. 10. A control sleeve 370' having a piston head 374' is integral with valve 812, extends downwardly therefrom, and seats against the outer surface of the lower portion of body 814. A check valve mechanism 430 like that described when reference was made to FIG. 2, is disposed within the case 46 and mandrel 28.

A retaining ring 816 is disposed in a groove provided in mandrel 28, with the retaining ring forming a stop to maintain the housing of the check valve 430 in position. A coil spring 806 is disposed in an annular space between the retaining ring 816 and a ring 818 which is anchored to the bottom of control sleeve 370' by means of bolts 820.

The operation of the impediment mechanism illustrated in FIG. 10 is as follows. The mandrel is illustrated in its lowered position, preparatory to the commencement of a jarring stroke. In this position, the spring 806 is compressed between the retaining rings 816 and 818. The compression force generated by the spring 806 acts on the control sleeve 370' by pulling the same in a downward direction relative to ring 816 and hence the mandrel 28. However, it should be recalled that chamber 394 is filled with fluid, through the action of check valve 430, upon the jarring device being set for a jarring stroke. As the mandrel 28 is raised, the sleeve 68 seats against the upper portion of body 814, and chambers 70 and 72 are separated. In response to the tension placed on the mandrel by the hoisting apparatus, intense pressure is generated in the chamber 70. This pressure is transmitted through slots 808 and ports 810, but retained by valve 812.

Some movement of the mandrel 28 occurs as the mandrel is pulled by the surface-mounted hoisting apparatus and therefore ring 818 separates from piston 86. This action permits the force of the spring 806 to move the control sleeve 370' in a downward direction. However, as the downward movement of control sleeve 370' is resisted by the fluid in chamber 394, this movement is impeded by the action of the meter 500.

As the fluid is released from chamber 394 by the meter 500, the control sleeve 370' slowly travels in a downward direction in response to the force exerted by the compression spring 806. As in the embodiment illustrated in FIG. 2, when the seal 378' in the head 374' of the control sleeve crosses port 356', fluid remaining in chamber 394 travels around the seal 378' through ports 354' and 356', and slots 352'. This fluid is therefore released into chamber 72 through a port 822 in valve 812.

When the seal 378' crosses port 356', the full force of the spring 806 moves the control sleeve 370', with its integral valve 812, past the ports 810. When this occurs, there is a sudden release of the generated pressure in chamber 70, and the mandrel moves rapidly in an upward direction until the hammer 100 strikes against the anvil 102. After this delivery of a jarring stroke, the device is again ready for a resetting operation.

Figure 11:
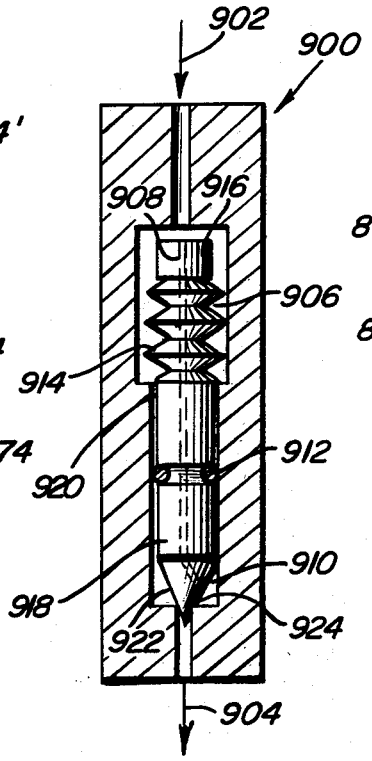
FIG. 11 is a cross section of a metering valve having a generally linear hydraulic choke.

In FIG. 11, there is shown a simplified metering valve 900 utilizing generally linear fluid passageways. In this valve, fluid is metered between an inlet 902 and an outlet 904. Fluid from the inlet 902 enters a chamber 906, flows through a generally linear passageway 908, and exits into a further chamber 910 separated from chamber 906 by means of a seal 912 in the body of a movable plug 918. Belleville washers 914 act between a shoulder 916 at the upper region of the plug 918, and a corresponding shoulder 920 at the base of the surrounding structure.

As can be seen, the washers 914 urge the nose 922 of the plug 918 away from a seat 924 in communication with the outlet 904. However, when the pressure builds up at inlet 902 and hence in chamber 906, a pressure drop is developed across the plug 918 through the choking effect of the passageway 908. As a result, the nose 922 of the plug 918 moves toward the seat 924. An equilibrium condition is reached for a given pressure in chamber 906, determining the flow rate of the fluid through the outlet 904.

In the embodiment of the meter 500 illustrated in FIGS. 7 and 8 wherein a spiral passage is used for metering the flow of fluid, a substantial choking effect can be obtained with relatively large cross section fluid passage. By using the generally linear passage illustrated in FIG. 11, on the other hand, the passage must be significantly smaller in cross section to develop the same choking effect and hence the meter 900 is far more susceptible to clogging than is the meter 500.

Numerous modifications and variations of the present invention are certainly possible in light of the above teachings. It should therefore be understood that the foregoing description has been given merely for purposes of illustration, and is in no way intended to limit the scope of the present invention. Rather, it is intended that the present invention may be practiced otherwise than as specifically described above, and should be limited only as defined in the appended claims.

What is claimed is:

1. A hydraulic jarring device for dislodging an object lodged in a well, the device operating by means of a high pressure chamber and, an exhaust chamber and comprising:

an elongated, generally hollow barrel;

an elongated mandrel coaxially mounted with said barrel and adapted to move relative thereto in an axial direction under tension to generate pressure in the high pressure chamber;

anvil means mounted on one of said barrel or said mandrel;

hammer means mounted on the other of said barrel or said mandrel, axially aligned with said anvil means and adapted to impact thereagainst in response to abrupt venting of the high pressure chamber to the exhaust chamber;

impact control means for selectively isolating said high pressure chamber from said exhaust chamber for preventing impact between said hammer means and said anvil means;

a collapsible chamber pressurized with hydraulic fluid independently of the high pressure chamber for controlling the operation of said impact control means;

release means for abruptly releasing the hydraulic fluid from said collapsible chamber after a predetermined contraction thereof to effect said abrupt venting of said high pressure chamber resulting in said hammer means impacting against said anvil means; and metering valve means connected to said collapsible chamber for controlling the rate at which the hydraulic fluid is released from the collapsible chamber up to said predetermined collapse.

2. The hydraulic jarring device recited in claim 1, wherein said metering valve means comprises an inlet receiving hydraulic fluid from said collapsible chamber; an outlet expelling hydraulic fluid; movable restrictor means for conducting restricted flow of hydraulic fluid between the inlet and outlet valve means connected to the restrictor means for controlling the flow of hydraulic fluid through said outlet in response to movement of the restrictor means, and differential pressure control means for controlling movement of the restrictor means in response to a pressure drop of the fluid undergoing restricted flow through the restrictor means.

3. A hydraulic jarring device for dislodging an object lodged in a well, the device operating by means of a high pressure side and a low pressure side, and comprising:

an elongated, generally hollow barrel;

an elongated mandrel coaxially mounted with said barrel and adapted to move relative thereto in an axial direction;

anvil means mounted on one of said barrel of said mandrel;

hammer means mounted on the other of said barrel or said mandrel, axially aligned with said anvil means and adapted to impact thereagainst;

impact control means for selectively isolating said high pressure side from said low pressure side for preventing impact between said hammer means and said anvil means, and communicating said high pressure side and said low pressure side for developing impact between said hammer means and said anvil means;

a collapsible chamber adapted to be filled with a pressurized hydraulic fluid, for controlling the operation of said impact control means;

release means for abruptly releasing the hydraulic fluid from said collapsible chamber to permit a rapid collapse thereof after a predetermined collapse and thereby cause said impact control means to communicate said high pressure chamber with said low pressure chamber resulting in said hammer means impacting against said anvil means; and metering valve means associated with said collapsible chamber for controlling the rate at which the hydraulic fluid is released from the collapsible chamber up to said predetermined collapse, wherein said metering valve means comprises an inlet for receiving hydraulic fluid from said collapsible chamber; an outlet for expelling hydraulic fluid; a movable plug whose movement is dependent upon the pressure of hydraulic fluid in said collapsible chamber; and valve means for controlling the flow of hydraulic fluid through said outlet means, said valve means being connected to and controlled by the movement of said plug, and said plug including a spiral duct through which hydraulic fluid flows for generating a pressure drop, the magnitude of which determines the movement of said plug.

4. The hydraulic jarring device recited in claim 3, and further comprising spring means for biasing said plug in a direction which opens said outlet, and wherein the pressure of fluid in said collapsible chamber develops a force which urges said plug toward said outlet.

5. The hydraulic jarring device recited in claim 4, wherein said spring means is positioned between said spiral duct and said collapsible chamber.

6. The hydraulic jarring device recited in claim 4, wherein said spring means is positioned between said spiral duct and said outlet.

7. The hydraulic jarring device recited in claim 1, wherein said release means comprises passageways defined in said mandrel which fluidly connects said collapsible chamber to said exhaust chamber when said predetermined collapse is attained.

8. The hydraulic jarring device recited in claim 1, and further including filling means for filling said collapsible chamber with hydraulic fluid.

9. The hydraulic jarring device recited in claim 8, wherein said filling means comprises a one-way check valve.

10. The hydraulic jarring device recited in claim 1, and further comprising fluid separation valve means for balancing the hydraulics of said device with the hydraulic head in said well.

11. A hydraulic jarring device for dislodging an object lodged in a well, the device comprising:

an elongated generally hollow barrel;

an elongated mandrel coaxially mounted in said barrel and adapted to move relative thereto in an axial direction;

anvil means mounted on one of said barrel or said mandrel;

hammer means mounted on the other of said barrel or said mandrel, axially aligned with said anvil, and adapted to impact thereagainst;

first connector means for connecting one of said barrel or said mandrel to the lodged object;

second connector means for connecting the other of said barrel or mandrel to a tension device which generates a pull in the direction necessary to dislodge the lodged object; and hydraulic control means for controlling the relative motion between said barrel and said mandrel in such a manner that during the early stages of pull experienced by said second connector means, there is at most only slight relative motion between said barrel and said mandrel, and that during the later stages of pull, there is an abrupt release and substantial relative motion between said barrel and mandrel occurs whereby said hammer impacts against said anvil to dislodge said object;

said control means including metering means for receiving hydraulic fluid under pressure and for controlling the rate at which said hydraulic fluid can exit the same during said early stages of pull, said metering means comprising an inlet for receiving hydraulic fluid from a collapsible chamber; an outlet for expelling hydraulic fluid; a movable plug whose movement is dependent upon the pressure of hydraulic fluid in said inlet; and valve means for controlling the flow of hydraulic fluid through said outlet; said valve means being connected to and controlled by the movement of said plug and said plug including a spiral duct through which hydraulic fluid flows, for generating a pressure drop, and magnitude of which determines the movement of said plug.

12. The hydraulic jarring device recited in claim 11, and further comprising spring means for biasing said plug in a direction which opens said outlet, and wherein the pressure of fluid in said inlet develops a force which urges said plug toward said outlet.

13. In a hydraulic jarring device comprising a tubular barrel, an elongated cylindrical mandrel telescopingly received in the tubular barrel, an annulus between the barrel and the mandrel, a pressurizable chamber in the annulus and adapted to contain hydraulic fluid, and a metering mechanism for controlling abrupt release of the fluid contained in the pressurizable chamber into the annulus; a housing located outside of said pressurizable chamber and surrounding said tubular mandrel; at least one elongated cylindrical plunger means slidingly received in an axial bore defined in said housing, each of said plunger means comprising a yoke at one end thereof; and movable valve means associated with each said plunger means and comprising an actuating rod having on one end an engaging means received in said yoke and at the other end a sealing head; first fluid communicating means for establishing fluid communication between the inside of said housing and said pressurizable chamber; second fluid communication means for establishing fluid communication between the inside of said housing and said annulus outside of said pressurizable chamber; and biasing means for urging said sealing head into a position which closes communication between said first and second fluid communication means; said sealing head serving to selectively block and enable the release of the hydraulic fluid contained in said pressurizable chamber into said annulus.

14. In a hydraulic jarring device comprising a tubular barrel, an elongated cylindrical mandrel telescopingly received in the tubular barrel, an annulus between the barrel and the mandrel, a pressurizable chamber in the annulus and containing hydraulic fluid, and a mechanism for selectively blocking and enabling the release of fluid contained in the pressurizable chamber into the annulus; a collapsible chamber for housing hydraulic fluid; valve means for filling said collapsible chamber with hydraulic fluid; and a metering valve means for releasing hydraulic fluid from said collapsible chamber into said annulus which includes a valve housing having an axial bore therein, a bleeder valve means positioned axially within said axial bore separating said bore into first and second chambers, said first chamber being in fluid communication with said collapsible chamber, a duct establishing fluid communication between said first and second chambers, an outlet means for establishing fluid communication between said second chamber and said annulus, a blocking valve means for selectively enabling and restricting fluid communication between said second chamber and said annulus, and means for controlling said blocking valve means.

15. A device for metering the flow of fluid in a well jar, and comprising: an inlet passage into which the fluid to be metered flows; an outlet passage out of which the metered fluid flows; an intermediate chamber between said inlet passage and said outlet passage; valve means for regulating fluid flow within said chamber; biasing means for biasing said valve means toward reducing restriction of said outlet passage; and choking means defined by a substantially helical flow path for restrictively conducting fluid through said chamber and developing a force urging said valve means toward increasing restriction of said outlet passage to regulate fluid flow therethrough.

16. The device recited in claim 15, wherein said choking passage means includes a spiral passage defined between external threads of said plug and a housing in which said plug moves, said spiral passage having an inlet in communication with the inlet passage and an outlet in communication with said intermediate passage.

17. The device recited in claim 15, wherein said plug has a rod extending therefrom, in the direction of said inlet passage, and a shoulder at the remote end thereof; and wherein said biasing means comprises a spring acting between said shoulder and an abutment surface on a housing in which said plug moves.

18. In a hydraulic jarring device having axially elongated members positioned within a well bore for relative axial movement to an impact position under applied tension upon abrupt venting of a pressure chamber through a control valve interconnecting said pressure chamber with an exhaust chamber; the improvement which includes means connected to said members forming a control chamber pressurized with fluid independently of the pressure chamber, means to reduce the volume of said control chamber during generation of pressure within the pressure chamber when the elongated members are tensioned, metering means for restrictive venting of the control chamber until the volume of the control chamber is reduced to a predetermined volume, and means responsive to reduction of the control chamber to said predetermined volume for abruptly venting the pressure chamber.

19. The combination of claim 18, wherein said metering means includes restrictor means for restricting flow of fluid from the control chamber, valve means for controlling flow of fluid from the restrictor means to the exhaust chamber, and differential pressure means responsive to a pressure drop of the fluid conducted through the restrictor means for actuating the valve means.

20. The hydraulic jarring device recited in claim 14 wherein said duct establishing fluid communication between said first and second chambers is defined by an elongated plug within a cylindrical bore.

21. The hydraulic jarring device recited in claim 14 wherein said duct establishing fluid communication between said first and second chambers comprises a surface channel defined by a cooperating cylindrical bore and maiden plug.

22. The hydraulic jarring device recited in claim 1 wherein said metering valve means is adjustable to vary the rate at which the hydraulic fluid is vented from the collapsible chamber.

23. The hydraulic jarring device recited in claim 13 and including adjustable means to vary the biasing means and thereby alter the regulation of fluid flow from said intermediate chamber to said outlet passage.

24. The hydraulic jarring device recited in claim 11 wherein said control means also includes a control valve for abruptly venting hydraulic fluid from a high pressure chamber to an exhaust chamber.

25. The hydraulic jarring device recited in claim 24 wherein a predetermined quantity of hydraulic fluid exiting past said metering means automatically opens said control valve.

26. The hydraulic jarring device recited in claim 13 wherein said metering mechanism, comprises a collapsible chamber adapted to contain hydraulic fluid independent of said pressurizable chamber; a metering valve means to control the rate at which hydraulic fluid is released from the collapsible chamber; and means to permit rapid collapse of said collapsible chamber upon the flow of the flow of a predetermined quantity of fluid through said metering valve means.

27. The hydraulic jarring device recited in claim 26 wherein said metering valve means includes a movable restrictor means for conducting restricted flow and separate nose valve means connnected to the restrictor means for controlling the flow of hydraulic fluid through said metering valve means.

28. The hydraulic jarring device recited in claim 1, wherein said impact control means comprises a pair of telescoping cylindrical sleeves, one of which defines a valve body and other defines a valve seat.

29. The hydraulic jarring device recited in claim 28 wherein said cylindrical member defining the valve body is associated with said collapsible chamber so that upon collapsing of said chamber said sleeve is moved in a direction toward opening said valve means.

* * * * *